United States Patent [19]

Woxland

[11] 4,206,579

[45] Jun. 10, 1980

[54] CARTON CLOSURE OUTFOLDER

[75] Inventor: Robert J. Woxland, Eden Prairie, Minn.

[73] Assignee: Paxall, Inc., Chicago, Ill.

[21] Appl. No.: 17,391

[22] Filed: Mar. 5, 1979

[51] Int. Cl.[2] ..... B65B 7/20

[52] U.S. Cl. ..... 53/484; 53/491; 53/376; 93/39.1 P

[58] Field of Search ..... 53/484, 491, 376, 377; 93/39.1 R, 39.1 P, 39.2

[56] References Cited

U.S. PATENT DOCUMENTS

| | | | |
|---|---|---|---|
| 3,267,637 | 8/1966 | Baker | 53/484 |
| 3,587,411 | 6/1971 | Theys et al. | 53/376 X |

*Primary Examiner*—Travis S. McGehee

*Attorney, Agent, or Firm*—Fitch, Even & Tabin

[57] ABSTRACT

Apparatus for automatically outfolding the leading and trailing gusset panels of the end closure of a rectangular carton being moved along a predetermined path on a continuous conveyor. First and second arms are attached to a vertical shaft and to a sleeve mounted for independent rotation about the shaft. The shaft and sleeve rotate in opposite directions so that one arm contacts the leading gusset panel and folds it outward along a line at an angle to its hinged edges and the other arm subsequently contacts the trailing gusset panel and similarly folds it outward. A plow positioned adjacent the conveyor path begins to plow the major end closure panel toward the carton opening while the rotating arm is in contact with the leading gusset panel.

9 Claims, 8 Drawing Figures

28
23
23a
25
13
19
29
11
15
27
21
21a
17
43
83
87
89
45

CARTON CLOSURE OUTFOLDER

BACKGROUND OF THE INVENTION

This invention relates to packaging and more specifically to apparatus for folding the end closures of cartons of the type which include a pair of gusset closure panels.

U.S. Pat. No. 4,046,308, issued Sept. 6, 1977, discloses such an end-sealing package which is designed to provide a totally moisture-resistant inner barrier within an outer paperboard carton. The package is formed from a laminated blank wherein a moisture-resistant film material having heat-sealing characteristics, such as polyethylene film, is adhered to a fiberboard substrate by a heat-weakenable laminant, such as microcrystalline wax. The blank may be formed by die-cutting sheets or rolls of such a lamination so that the two layers will be substantially coextensive. During the formation of the blank into a tubular body by side-seaming and subsequentially during the heat-sealing of the end closures, portions or panels of the fiberboard substrate are separated from the inner lining by selective heat delamination.

Apparatus for closing and sealing the ends of packages of this general type, which is illustrated in the aforementioned U.S. patent, takes the form of a pair of synchronized, intermittently rotating turrets, each of which has a plurality of pocket members into which individual cartons are received. More versatile apparatus for closing and sealing such packages has been found desirable.

BRIEF SUMMARY OF THE INVENTION

It has been found advantageous to create packaging apparatus for the high-speed handling, filling, closing and sealing of this general type of gusseted cartons which employs both straight-line and rotary movement of the packages. The filling of the carton is efficiently carried out in a rotary, turret-like arrangement which is located between two straight-line sections where the formation of the bottom and top end closures are respectively effected. It has been found that there are advantages to manipulating the end closures during the sealing and closing steps while the cartons are being moved in a straight-line. One advantage lies in being able to run the conveyor continuously, as opposed to intermittently, which itself is conducive to higher speed operation, and another lies in the versatility of operation. However, there is difficulty in effecting the folding of gusseted end closures while they are continuously moving, and the present invention provides apparatus for automatically carrying out such a folding operation.

DETAILED DESCRIPTION OF THE PREFERRED EMBODIMENT

Figures 1, 2, 3, 4:
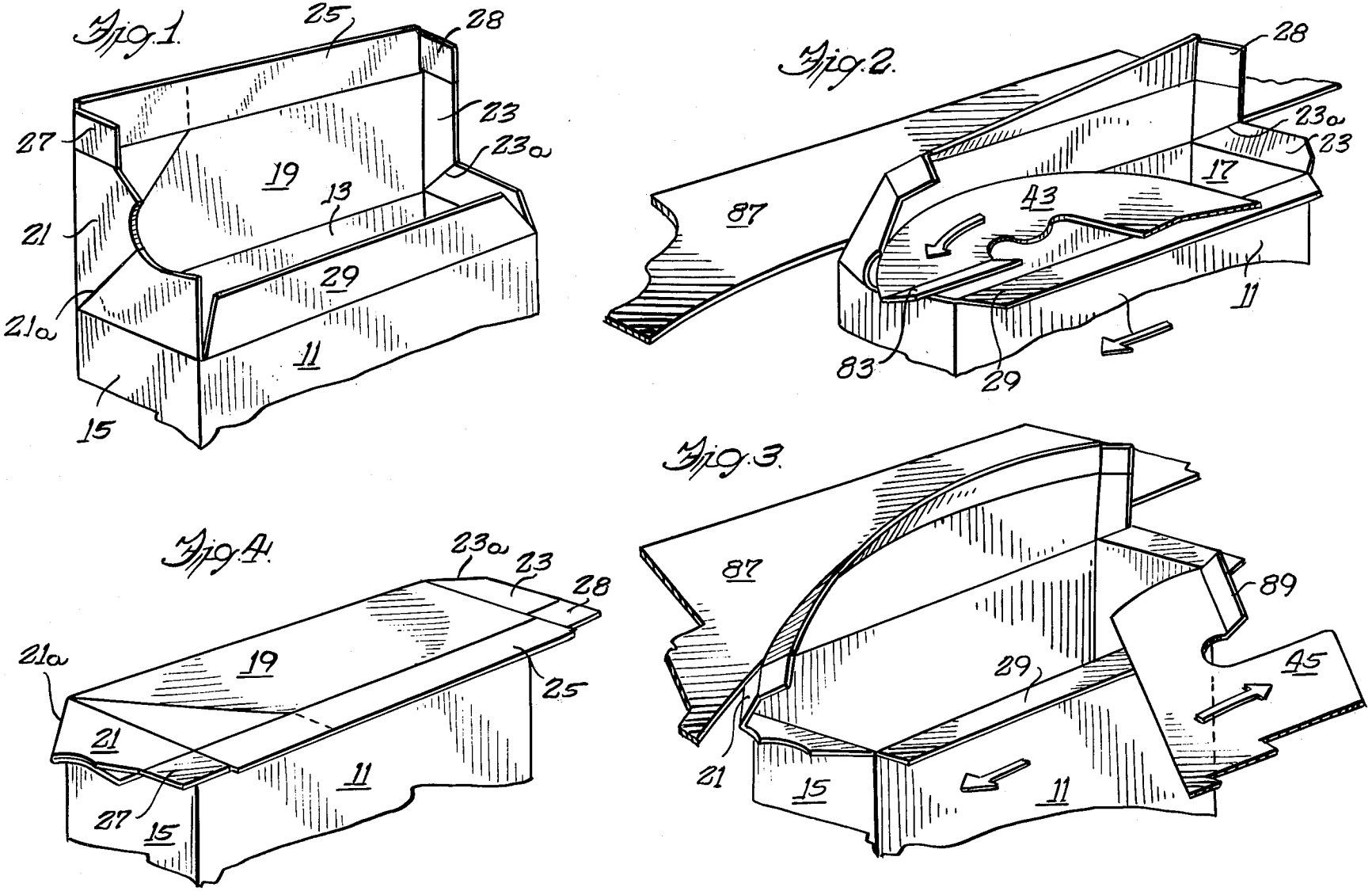
FIG. 1 is a fragmentary perspective view showing the top portion of a carton as it would appear in its filled condition prior to the folding of the upper end closure.
FIG. 2 is a similar view of the carton depicted in FIG. 1 shown with the leading gusset panel just having been outfolded by contact with a rotating arm.
FIG. 3 is a view similar to FIG. 2 showing the carton with the leading gusset outfolded and with the outfolding of the trailing gusset just beginning by its contact with a second rotating arm.
FIG. 4 is a similar view of the carton with the outfolding completed showing the upper closure plowed down into the orientation wherein heat-sealing of the film liner occurs.

The overall apparatus automatically removes the flat-folded carton blanks from a stack in a magazine and forms, fills and seals the blanks to create complete packages. Described in detail hereinafter is only that portion of the overall apparatus for effecting the outfolding of the top end closure just prior to heat-sealing. It should be understood that substantially the same mechanism is employed to initially outfold and seal the bottom end closure; however, inasmuch as it is easier to illustrate the mechanism for operating on the top end of the carton, its illustration was chosen.

A typical gusseted carton of the general type which the present invention is designed to manipulate is depicted in FIGS. 1 through 4. The carton is formed from a single blank of laminated material, namely, a fiberboard substrate to which polyethylene sheeting is adhered by a thin layer of heat-flowable material, such as microcrystalline wax. The fiberboard substrate may be of any reasonable density and thickness, for example, 40 pound bleached kraft board. The sheeting may be as thin as 2 mil low density polyethylene film, or a suitable lamination of foil and one or more synthetic resin materials may be used so long as the exposed surface is a heat-sealable material. The laminating material is preferably a microcrystalline wax or some other suitable material which melts at a temperature below the heat-sealing temperature of the thermoplastic surface of the sheeting. Accordingly, as pointed out in the aforementioned patent, during heat-sealing operation, the wax melts and is absorbed into the relatively porous fiberboard surface, thus selectively delaminating the fiberboard substrate from the film liner in the particular region.

In the side-seaming operation, with which the present invention is not concerned, the flat blank is formed into a flat-folded tube which, when opened, has a rectangular cross section. The carton has four sidewalls which are referred to, for reference purposes, as a front wall 11, a rear wall 13 and a pair of lateral walls 15,17. The end closure is formed by panels which are extensions of these sidewalls and which are hinged to the upper edges thereof. A similar end closure is preferably provided at the bottom of the carton; however, a different type of end closure could be used if desired for some reason.

The end closure includes a major or cover panel 19 which is hinged to the rear wall 13 of the carton and which is of a sufficient size to completely cover the entire opening. A pair of gusset panels 21,23 are provided at the top of each of the lateral sidewalls 15,17, one edge of which is hinged thereto whereas the other edge of which is hinged to a lateral edge of the cover panel 19. These gusset panels 21,23 are provided, respectively, with a crease or fold line 21*a*,23*a* which extends at a 45° angle from the edge along which the gusset is hinged to the underlying sidewall. A flange panel 25 is attached to the free edge of the cover panel 19, and short flange extensions 27,28 are hinged to the upper edges of the gusset panels 21,23. A short flap 29 is hinged to the upper edge of the front wall 11; however, the adjacent edges between the front flap 29 and the gusset panels 21,23 are only partially severed so that the substrate or fiberboard layer is weakened but the sheeting is not cut. Thus, when the front flap 29 and the gusset panels 21,23 are outfolded, the fiberboard tears to the corners, and the sheeting stretches across these corners and assures a complete seal is formed in the regions of the flange extensions 27,28 during the heat-sealing step, as described in detail in the aforementioned patent.

The cartons are continuously moved along throughout the overall apparatus by an endless roller chain conveyor 31 which carries a series of U-shaped pocket members 33, each of which is proportioned to receive a single carton. The conveyor 31 includes a heavy roller chain to which each pocket member is linked by a suitable bracket 35. The conveyor 31 moves the cartons around an endless path which includes two long straight run sections and a rotary section at each end. Infeed and take-off sections are located at one rotary end section, and a filling station is located adjacent the other rotary end section. Accordingly, the bottom end closure is formed on the first straight run section, and the top end closure is formed and sealed on the second straight run section. The present invention is directed to the portion of the apparatus which, after the carton has been filled, folds the front flap outward, folds the gussets outward and plows the cover downward into the heat-sealing orientation shown in FIG. 4.

The cartons leaving the rotary filler section first engage a plow 37 (FIG. 5) which contacts the upstanding front flap 29 and bends it outward to a horizontal orientation as it is moved along by the conveyor. Once in this horizontal orientation depicted in FIG. 2, the front flap 29 passes underneath a retainer plate 39 which assures that it remains out of the way as the filled carton passes the gusset-outfolding station.

Mechanism 41 is provided for outfolding the gussets 21,23 which is rotary in nature and is continuously driven so as to move in synchronized motion with the pocket members 33 that are traveling along the main conveyor 31. The mechanism 41 utilizes a pair of counter-rotating blades or arms 43,45 which sequentially engage the leading and trailing gusset panels 21,23, respectively, on the filled cartons as they are moved therepast.

The gusset outfolding mechanism 41 is supported from a base plate 47 which extends outward in cantilever fashion from the main frame 49 of the packaging apparatus. A hole in the base plate 47 allows passage therethrough of a main vertical shaft 51, and upper and lower bearing blocks 53,55 are appropriately attached as by bolts to the base plate 47 to support the shaft 51 for rotary movement. Upper and lower collars 57,59 adjacent the upper and lower surfaces of the bearing blocks secure the shaft 51 against longitudinal movement. A drive sprocket 61 is appropriately attached as by a set screw or a key, to the upper end of the shaft 51, and a drive chain 63 is entrained about the sprocket. The drive sprocket 61 rotates in a clockwise direction, as viewed from above, and its lower end carries a holder 65 which is suitably affixed to the shaft 51. The holder 65 carries the lower rotating arm 45 which engages the trailing gusset panel 23 of the carton.

Disposed about the lower portion of the shaft 51 and located just above the holder 65 is a sleeve 67 that is disposed concentrically about the shaft by a pair of internal bearings 69. The upper end of the rotary sleeve 67 is formed as a sprocket 71, and a roller chain 73 is entrained about the sprocket. A snap ring 74 fixes the location of the sleeve on the lower end, and a collar 75 restrains it against upward movement. A generally cylindrical holder 77 fits about the outer surface of the sleeve 67 and is connected thereto by a key 79 so that the sleeve and holder rotate in unison independent of the shaft 51. The rotary arm 43 is attached, as by screws, to the underside of the cylindrical holder 77 and has a downwardly off-set arm section which engages the leading gusset panel 21. The sprocket 71 is driven so as to cause the sleeve and holder 77 to rotate in counter-clockwise movement, as viewed from above.

Figure 7:
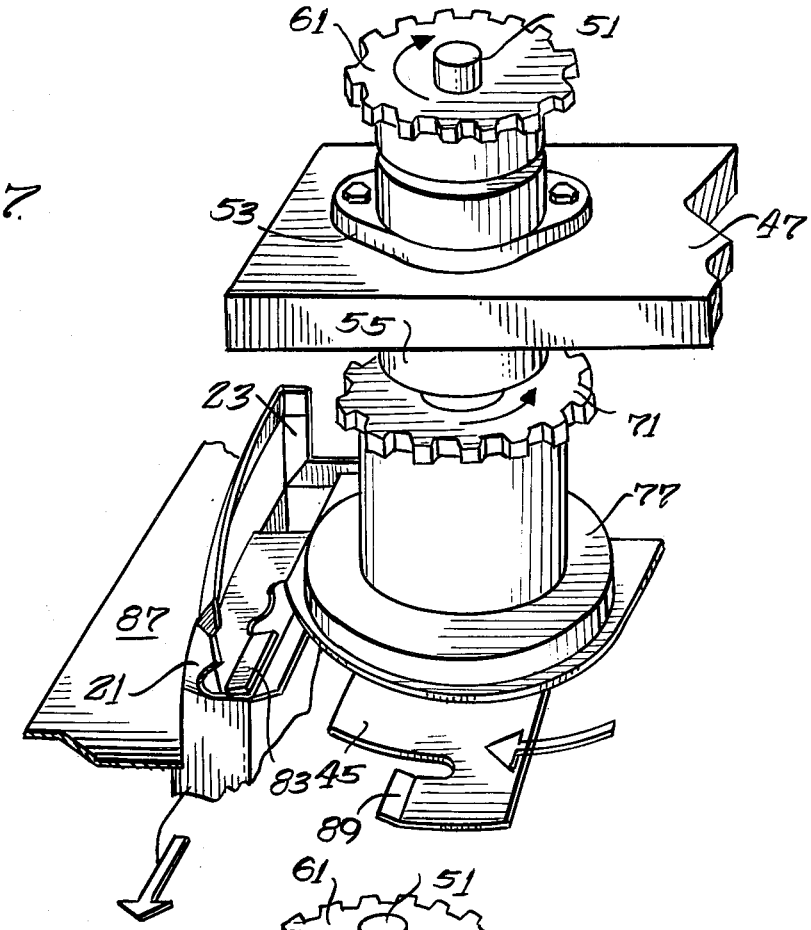
FIG. 7 is a fragmentary perspective view showing the outfolding of the leading gusset panel.
Figure 8:
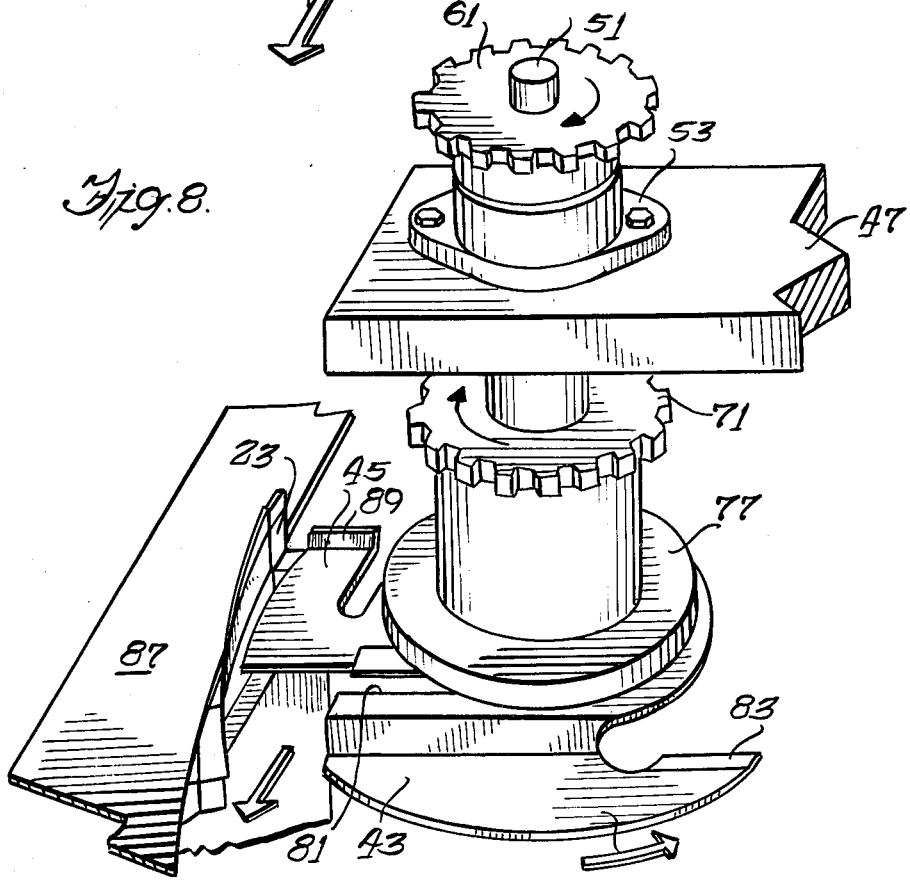
FIG. 8 is a similar perspective view showing the outfolding of the trailing gusset panel.

As previously indicated, the upper and lower rotary arms 43,45 are mounted for counter-rotating movement which is synchronized with the movement of the pocket members 33 carried by the main conveyor 31. The utilization of chain drive for the main conveyor and for the rotary arms allows precise synchronization to be achieved. Each of the arms 43,45 includes a central slot of sufficient size to allow it to be inserted about the shaft. FIG. 8 shows the slot 81 in the upper arm 43 which allows its precise adjustment in a radial direction so that it will engage the gusset at the desired location. As illustrated in FIG. 7, the sprocket 71 is driven so as to cause the upper arm 43 to rotate and engage the leading gusset 23 at about the location of the fold line 21*a*. The leading blade edge or plow 83 of the upper arm 43 is bent upward slightly for the purpose of creating an angle of contact with flap 21 of less than 90°. This angle insures that plow 83 will properly outfold flap 21 and not cut through it.

The arm 43 is somewhat longer in an arcuate direction than the lower blade 45. Its proportioning and mounting on the holder 77 are such that the leading edge 83 of the arm engages the gusset at a location just before the leading gusset panel 21 of the carton reaches position A indicated in FIG. 5 which is opposite to the center line of the shaft 51, (i.e., in a plane perpendicular to the path of movement). The angular speed at which the arm 43 rotates, when translated to straight line movement along the path, is faster than the longitudinal speed of the main conveyor 31, and thus the blade edge 83 moves ahead, relative to the carton being carried along the conveyor, folding the gusset panel outward along the crease line 21*a*.

Figure 5:
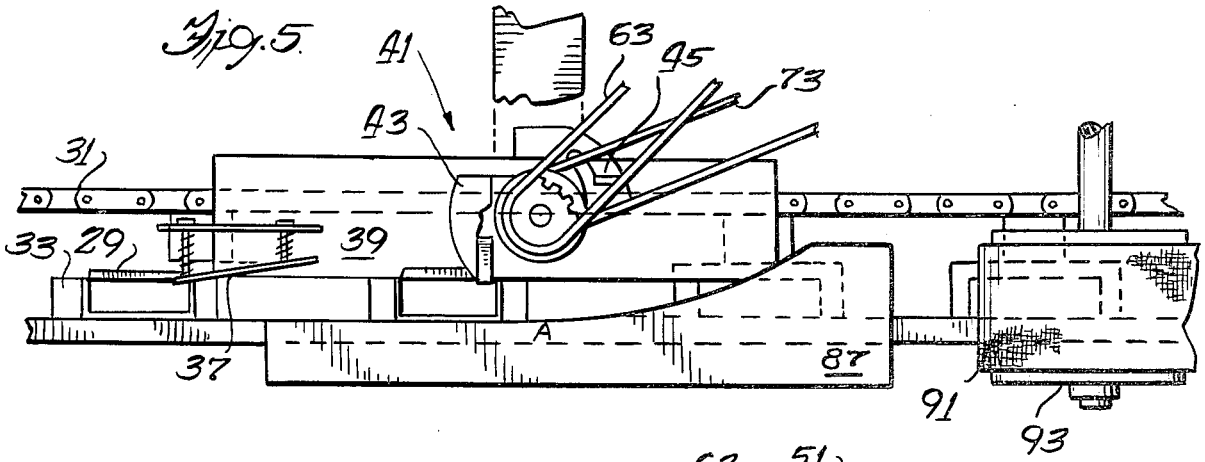
FIG. 5 is a plan view of a portion of the overall package-forming apparatus showing the station where the outfolding of the gusset panels of the upper end closure takes place.
Figure 6:
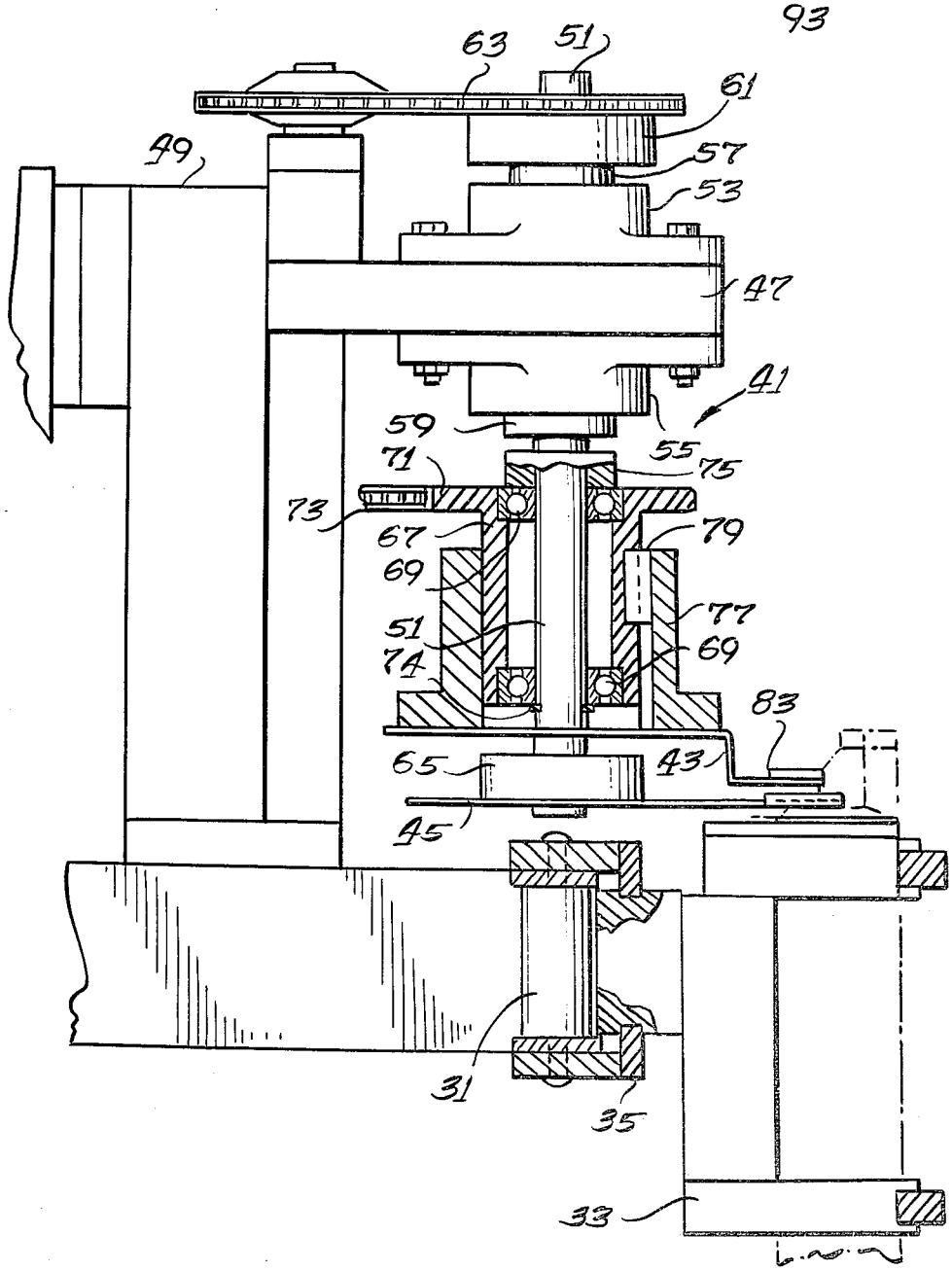
FIG. 6 is an enlarged section vertical view of the rotary apparatus for effecting the outfolding of the gusset panels with both rotating arms shown in the approximate position in which they contact the respective gusset panels, although it should be recognized that both arms would not simultaneously occupy the illustrated positions.

As best seen in FIG. 5, an upper stationary plow 87 having an arcuate vertical edge engages the cover panel 19 and begins to fold it downward just after the outfolding of the gusset 21 by the upper rotating arm has begun. This is illustrated in FIG. 7.

The lower arm rotates clockwise and also has a slightly upwardly bent blade edge 89 that engages the trailing, narrower gusset panel 23 at a time when the panel is just about opposite position A, i.e., the center line of the shaft 51. The lower arm 45 is shorter in an arcuate direction than the arm 43, and because it is moving in a direction opposite to the movement of the carton, it is in contact with the gusset 23 a much shorter time period.

FIG. 8 depicts a time just beyond the initial engagement of the lower blade edge 89 with the gusset, and it can also be seen that the plowing down of the leading edge of the cover panel 19 has begun. Thus, the blade edge 89 of the lower arm 45 initially moves the trailing gusset panel 23 into the outfolded configuration, and it is further folded as the arcuate edge of the arm slides over the lower region of the gusset panel below the crease line 23*a*. The arcuate edge of the lower arm 45 decreases in radius so that it clears the end of the crease line 23*a* as the carton moves in the opposite relative direction. At the same time, the movement of the carton along the conveyor path is causing the cover panel 19 to be plowed continuously further downward until it nearly reaches the horizontal orientation depicted in FIG. 4.

As the pocket member 33 emerges from below the upper plow 87 (FIG. 5) it is nearly immediately engaged by the undersurface of an endless belt 91 that passes over a guide roller 93 as it enters the heat-sealing station. The conveyor 31 carries the outfolded carton under the guide roller 93 which assures the top end closure has been flattened to the configuration shown in FIG. 4. In this configuration, heat-sealing of the thermoplastic sheeting surfaces is effected to complete the sealing of the inner liner via heat supplied through the heat-conductive endless belt 91. At the same time, delamination of the cover panel 19 and the three panel portions attached to it, namely, the front flange 29 and the upper regions of the gusset panels 21, 23 above the crease lines 21*a* and 23*a*, is effected. Delamination readies filled and sealed cartons for the subsequent infolding of the gusset panels and the ultimate adhesive attachment of the front flange panel 25 to the upper portion of the front wall 11 of the carton to complete the package.

Although the apparatus has been described with regard to a preferred embodiment, it should be understood that changes and modifications as would be obvious to one having the ordinary skill in this art may be made without departing from the scope of the invention which is defined in the appended claims. Specific features of the invention are emphasized in the claims which follow.

What is claimed is:

1. Apparatus for automatically folding the end closure of a carton of rectangular cross section which end closure includes a major panel hinged to one sidewall of the carton and a pair of flanking gusset panels which are each respectively hinged to one edge of the major panel and to another adjacent sidewall of the carton, which apparatus comprises conveyor means for moving said carton along a predetermined path with one of the gusset panels leading and the other gusset panel trailing, a shaft mounted for rotation generally adjacent said predetermined path, sleeve means mounted for independent rotation about said shaft, first and second arms attached respectively to one of said shaft and said sleeve means, and means for rotating said shaft and said sleeve means in opposite directions so that said first arm contacts the leading gusset panel and folds it outward along a line at an angle to its hinged edges and so that said second arm subsequently contacts the trailing gusset panel and folds it outward along a line at an angle to its hinged edges.

2. Apparatus in accordance with claim 1 wherein said conveyor means moves said carton continuously along its path of movement at a predetermined rate of speed and wherein said first arm moves along said path of movement at a rate of speed faster than said predetermined rate.

3. Apparatus in accordance with claim 2 wherein plow means is positioned adjacent said path of movement in a location so that the major panel is being plowed toward the carton opening while said first arm is in contact with the leading gusset panel.

4. Apparatus in accordance with claim 1 wherein said conveyor means moves said carton continuously and wherein said second arm has an arcuate edge of decreasing radius which is in sliding contact with the outfolded trailing gusset as relative movement between said second arm and said conveyor continues.

5. Apparatus in accordance with claim 1 wherein said arms have upwardly inclined blade portions which constitute the first part of said arms that contact the gusset panels.

6. A method for automatically folding the end closure of a carton of rectangular cross section which end closure includes a major panel hinged to one sidewall of the carton and a pair of flanking gusset panels which are each respectively hinged to one edge of the major panel and to another adjacent sidewall of the carton, which method comprises continuously moving said carton along a predetermined straight-line path, with one of the gusset panels leading and the other gusset panel trailing, past an outfolding station at a predetermined rate of speed, rotating a first arm in one direction so that a radially outer section thereof intersects said predetermined path and contacts the leading gusset panel while moving at a rate of speed greater than said predetermined rate so as to outfold the leading gusset panel along a line at an angle to its hinged edges and rotating a second arm in an opposite direction so that a radially outer section of the second arm intersects said predetermined path, contacts the trailing gusset panel and folds it outward along a line at an angle to its hinged edges.

7. A method in accordance with claim 6 wherein the cartons are continuously moved past said station at a rate equal to one carton per each revolution of the first arm.

8. A method in accordance with claim 6 wherein said arms are rotated about the same axis.

9. A method in accordance with claim 6 which includes plowing the major panel toward a closed position while said first arm is in contact with said leading gusset panel.

* * * * *